US008967426B2

(12) United States Patent
Koike et al.

(10) Patent No.: US 8,967,426 B2
(45) Date of Patent: Mar. 3, 2015

(54) MEDICINE FEEDER AND MEDICINE DISPENSER

(75) Inventors: Naoki Koike, Toyonaka (JP); Akira Maeda, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 347 days.

(21) Appl. No.: 12/922,539

(22) PCT Filed: Apr. 16, 2010

(86) PCT No.: PCT/JP2010/056840

§ 371 (c)(1), (2), (4) Date: Nov. 4, 2010

(87) PCT Pub. No.: WO2010/119949

PCT Pub. Date: Oct. 21, 2010

(65) Prior Publication Data

US 2011/0042404 A1 Feb. 24, 2011

(30) Foreign Application Priority Data

Apr. 17, 2009 (JP) ..... 2009-101289

(51) Int. Cl.

| | |
|---|---|
| ***B65D 83/04*** | (2006.01) |
| ***B65H 3/00*** | (2006.01) |
| ***G07F 11/44*** | (2006.01) |
| ***G07F 9/02*** | (2006.01) |
| ***G07F 11/00*** | (2006.01) |
| ***G07F 17/00*** | (2006.01) |

(52) U.S. Cl.

CPC ..... *G07F 11/44* (2013.01); *G07F 9/026* (2013.01); *G07F 11/005* (2013.01); *G07F 17/0092* (2013.01)

USPC ..... 221/2; 221/1; 221/272

(58) Field of Classification Search

USPC ..... 221/2, 9, 13, 14, 21, 208, 258

See application file for complete search history.

(56) References Cited

U.S. PATENT DOCUMENTS

| | | | | |
|---|---|---|---|---|
| 5,097,982 | A * | 3/1992 | Kedem et al. | 221/3 |
| 6,012,602 | A * | 1/2000 | Yuyama et al. | 221/130 |
| 6,349,848 | B1 | 2/2002 | Uema et al. | |
| 6,516,969 | B2 | 2/2003 | Tamaoki | |
| 2008/0164281 | A1 | 7/2008 | Yuyama et al. | |
| 2010/0120572 | A1 * | 5/2010 | Takada | 475/207 |

FOREIGN PATENT DOCUMENTS

| | | |
|---|---|---|
| JP | 52-85674 | 7/1977 |
| JP | 2000-103404 | 4/2000 |
| JP | 2005-289506 | 10/2005 |
| JP | 2006-230763 | 9/2006 |
| JP | 3895989 | 3/2007 |
| JP | 2007-82622 | 4/2007 |

* cited by examiner

*Primary Examiner* — Gene Crawford
*Assistant Examiner* — Kelvin L Randall, Jr.
(74) *Attorney, Agent, or Firm* — Wenderoth, Lind & Ponack, LLP

(57) ABSTRACT

A medicine feeder's drive unit includes a drive motor, a gear transmission device, an output shaft and a switcher. The gear transmission device is constituted by a normal-rotation transmission path and a reverse-rotation transmission path provided between a motor shaft of the drive motor and the output shaft. The switcher selects one of the transmission paths for output of driving power from the drive motor. Thus, a jammed tablet in the medicine feeder can be cleared upon detection thereof, and reverse rotation of a rotor can be achieved without driving the motor in a reverse rotating direction, i.e., while the motor is in normal rotation setting.

7 Claims, 25 Drawing Sheets

MEDICINE FEEDER AND MEDICINE DISPENSER

BACKGROUND OF THE INVENTION

1. Technical Field

The present invention relates to a medicine feeder for storing tablets, capsules or other solid-type medicines by the kind and dispensing these medicines one by one in predetermined numbers based on prescription information. The invention also relates to a medicine dispenser including a plurality of the medicine feeders.

2. Description of the Related Art

A dispenser of solid medicines (hereinafter simply called "tablet(s)"), includes a predetermined number of cassette-type medicine feeders for dispensing tablets one by one. In the medicine feeder, a medicine storage has a bottom provided with a rotor. The rotor has an outer circumferential surface formed with a large number of pockets, and as the rotor rotates, tablets in the medicine storage are dispensed one by one from a dispensing spout (Japanese Patent Laid-Open No. 2005-289506).

In this dispensing process in the medicine dispenser, there are cases where a tablet becomes jammed resulting in seizing and disabling of the rotor due to a trouble caused by, for example, the shape of the tablet or the tablet's attitude at the time of entering the pocket in the outer circumference of the rotor.

When jamming of a tablet is detected, the state of clogging can be cleared by a known method: Upon detection of an overcurrent to a DC motor which drives the rotor, a determination is made that the motor has been locked by a jammed tablet and the motor is driven in a reverse direction momentarily (Japanese Patent Laid-Open No. 2000-103404).

Another known method is counting the quantity of tablets being dispensed and reversing the rotor momentarily upon a determination that the counting within a predetermined period of time gives a smaller number than predetermined due to a jammed tablet (Japanese Patent No. 3895989).

In whichever of the cases, reverse rotation of the rotor is achieved by inverting the polarity of electric current supplied to the motor.

SUMMARY OF THE INVENTION

1. Problems to be Solved by the Invention

However, reversing the motor rotation by inverting the polarity of the motor current as used in the conventional methods in order to reverse the rotation of the rotor has a problem since the motor is subjected to a strong torque at the time of reversing the rotation, and repeating such a cycle of normal-and-reverse rotations will lead to a problem of reduced life of the motor.

It is therefore an object of the present invention to solve the problem of jammed tablets in medicine feeders and in a medicine dispenser including the medicine feeders, through improvements on a motor drive unit which drives the rotor of the dispensing cassettes so that reverse rotation of the rotor can be achieved without rotating the motor in reverse, i.e. by reversing only the rotor while the motor remains in a normal rotation setting, in cases where a jammed tablet is detected.

2. Means for Solving the Problems

In order to solve the above-described problem, the present invention includes an aspect relating to a medicine feeder, and offers a medicine feeder which is provided by a combination of a dispensing cassette and a drive unit. The dispensing cassette includes a medicine storage for storing medicine, and a rotor at a bottom portion of the medicine storage. The drive unit includes a drive motor, a gear transmission device, an output shaft and a switcher. The gear transmission device has a normal-rotation transmission path and a reverse-rotation transmission path constituted by gear trains between a motor shaft of the drive motor and the output shaft. The switcher selects one of the transmission paths for an output of driving power from the drive motor to the dispensing cassette.

In the medicine feeder described above, when the drive unit drives the dispensing cassette, the drive power is transmitted via the normal-rotation transmission path, thereby driving the rotor in a normal rotation direction, to dispense a tablet. Upon detection of trouble such as a jammed tablet, the switcher switches the drive power transmission path to the reverse-rotation transmission path, and thereby the motor remains in the normal rotation setting but the rotor is driven in a reverse rotation direction in an attempt to clear the jammed tablet.

Also, in order to solve the above-described problem, the present invention includes an aspect relating to a medicine dispenser, and offers a medicine dispenser which includes a predetermined number of medicine feeders, a control circuit and a display device. The medicine feeder is provided by a combination of a medicine dispensing cassette and a drive unit. The dispensing cassette includes a medicine storage for storing medicine, and a rotor at a bottom portion of the medicine storage. The drive unit includes a drive motor, a gear transmission device, an output shaft, a switcher, a tablet counting sensor and a rotor-rotation detection sensor. The gear transmission device has a normal-rotation transmission path and a reverse-rotation transmission path between a motor shaft of the drive motor and the output shaft. The switcher selects one of the transmission paths for an output of driving power from the drive motor to the dispensing cassette. Upon detection of a stoppage of the rotor based on a signal from the rotor-rotation detection sensor, the control circuit controls the drive unit for reverse rotation of the rotor for a predetermined period of time followed by resumption to normal rotation.

3. Advantages of the Invention

As described, in cases where a tablet is jammed, the medicine feeder and the medicine dispenser according to the present invention are capable of attempting to clear the jammed tablet by driving the rotor in a reverse rotation direction without making the drive motor rotate in a reverse rotation direction. Since the motor is not driven in a reverse rotation direction, the motor can work under a reduced burden, and can have an extended life according to the present invention.

DETAILED DESCRIPTION OF THE INVENTION

Hereinafter, embodiments of the present invention will be described based on the attached drawings.

First Embodiment

Figure 1:
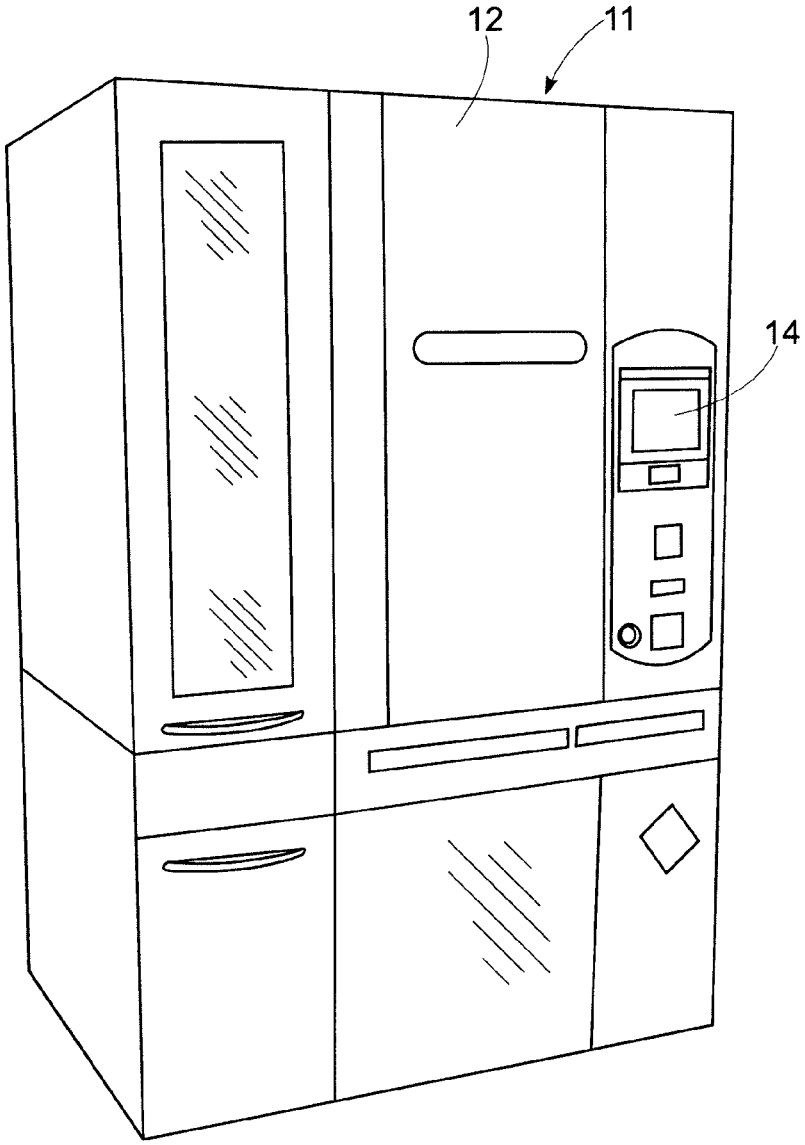
FIG. 1 is a perspective view of a medicine dispenser according to a first embodiment.

As shown in FIG. 1, a medicine dispenser 11 according to a first embodiment incorporates a large number of medicine feeders 13 (see FIG. 2) behind a front door 12. Also, an operation display panel 14 is provided on the right of the door 12.

Figure 2:
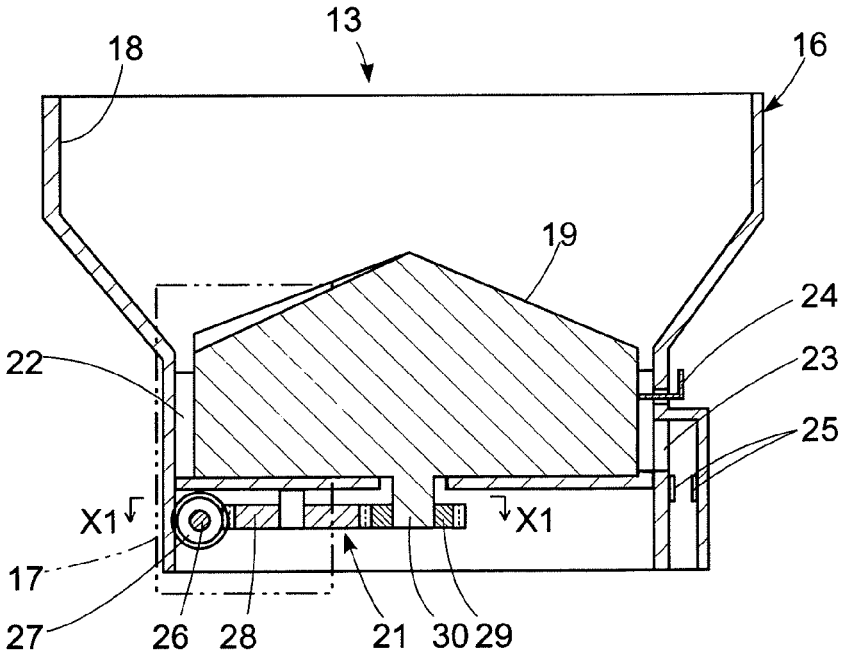
FIG. 2 is a sectional view of the medicine feeder.

As shown in FIG. 2, the medicine feeder 13 is composed of a dispensing cassette 16 and a drive unit 17. The dispensing cassette 16 is conventional (see Japanese Patent Laid-Open No. 2005-289506), and includes a medicine storage 18 which stores tablets, a rotor 19 provided at a bottom of the medicine storage 18, a gear transmission section 21 provided at a bottom surface of the medicine storage 18, and other components.

Drive power from the drive unit 17 is transmitted via the gear transmission section 21 to rotate the rotor 19, and in this rotation, tablets T (see FIG. 3) in the medicine storage 18 are distributed into pockets 22 between a large number of vertical ribs 20 provided in an outer circumferential surface of the rotor 19. Near a dispensing spout 23, a partitioning member 24, which is like a comb having elastic bristle teeth, is inserted from a slit 24*a* across the pocket 22 as indicated by Arrow "a", so that there is only one tablet T below the partitioning member 24. This singularly isolated tablet T is dispensed into a container or the like upon coming to the dispensing spout 23. The dispensing spout 23 is provided with an optical, tablet counting sensor 25 which includes a light emitter and a light receiver.

The gear transmission section 21 is composed of a worm gear 27 attached to an input shaft 26; a worm ring 28 engaged therewith; and a rotor gear 29 engaged with the worm ring 28. In the case shown in the Figure, the worm gear 27 has a right-hand helix (see FIG. 4). The input shaft 26 is connectable with and disconnectable from an output shaft 31 (see FIG. 4) of the drive unit 17 via couplings 32, 33.

Figure 4:
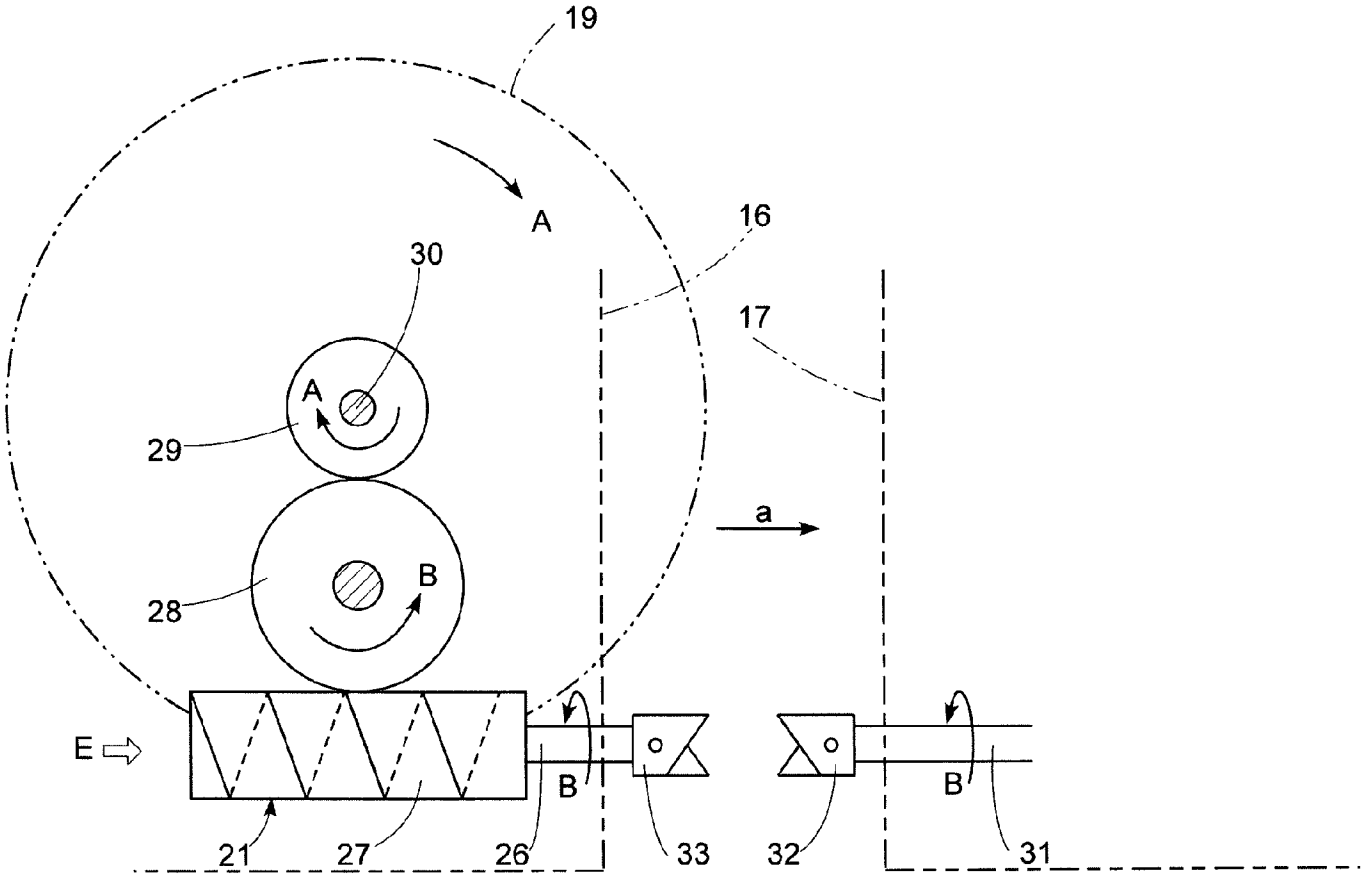
FIG. 4 is a simplified plan view of a horizontal section taken along lines X1-X1 in FIG. 2.

FIG. 4 shows rotation directions of the gears 27, 28 and 29 as viewed from a line X1-X1 in FIG. 2. In the Figure, Arrow A indicates clockwise rotation, i.e., normal rotation, whereas Arrow B indicates counterclockwise rotation, i.e., reverse rotation. FIG. 4 shows a dispensing state in which the rotor gear 29 is rotating normally, causing normal rotation of a rotor shaft 30 and the rotor 19 which is integral therewith.

In this case, when the input shaft 26 rotates in a reverse direction, the worm gear 27, which has a right-hand helix as described above, causes the worm ring 28 to rotate in a reverse direction, so the rotor gear 29 and the rotor shaft 30 make normal rotation. The statement that the input shaft 26 makes reverse rotation means that the input shaft 26 makes counterclockwise rotation as indicated by Arrow B when the drive-source side is viewed from the load side as shown by white Arrow E.

As defined above, in the present specification, the direction of rotation of any rotating member will be based on a view obtained when the drive-source side is viewed from the load side: Clockwise rotation will be called normal rotation and indicated by a letter A whereas counterclockwise rotation will be called reverse rotation and indicated by a letter B.

The dispensing cassette 16 has the gear transmission section 21 as described so far. Thus, in order to cause normal rotation of the rotor 19 for dispensing a tablet, it is necessary to provide a reverse-rotation input to the input shaft 26, and on the contrary, in order to make reverse rotation of the rotor 19, it is necessary to make a normal-rotation input to the input shaft 26.

Figure 5:
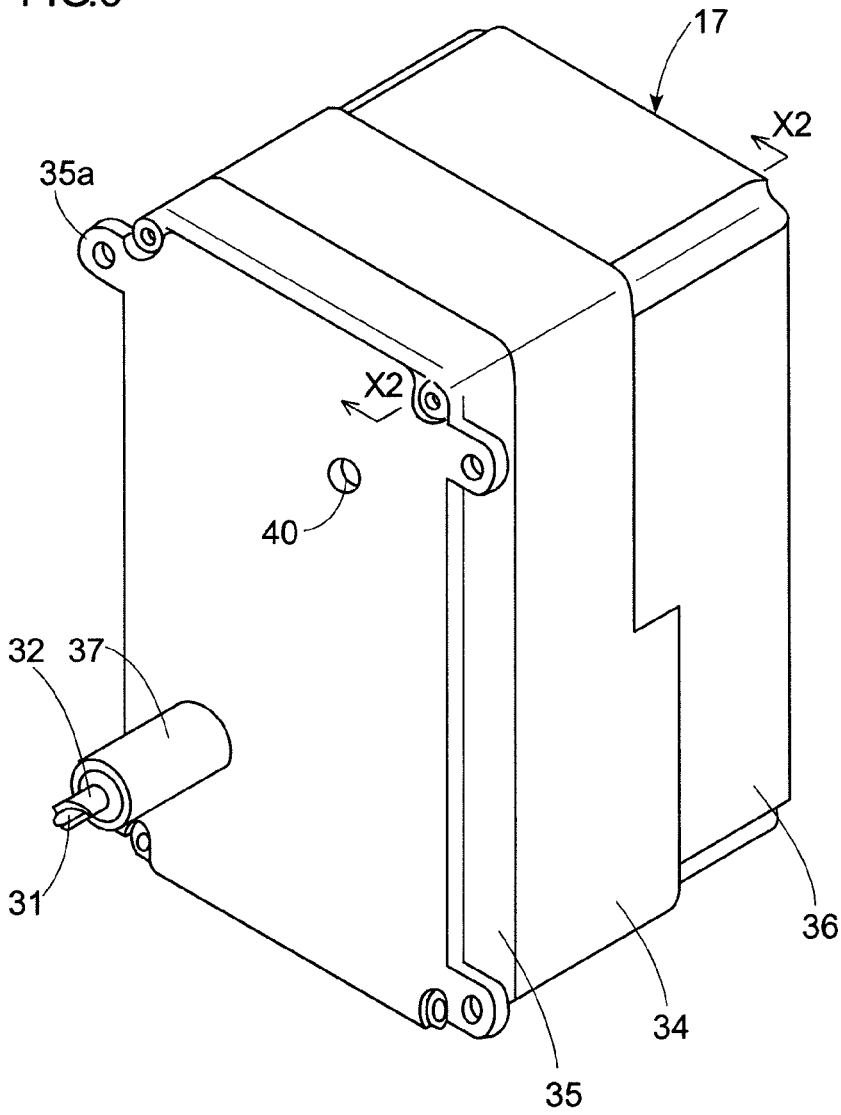
FIG. 5 is a perspective view of a drive unit.

As shown in FIG. 5, the drive unit 17 has a bearing sleeve 37, which protrudes from a lid case 35. The output shaft 31 has its tip portion inserted into the bearing sleeve 37. The coupling 32 is attached to the tip portion of the output shaft 31. The drive unit 17 has four mounting tabs 35*a* along a side edge of the lid case 35, and is fixed to the dispenser 11 by screwing to an appropriate position in the dispenser 11 so that the output shaft 31 is oriented in the forward direction.

When a dispensing cassette 16, which is to be combined with the drive unit 17, is inserted horizontally from the front of the dispenser 11 (see Arrow "a" in FIG. 4), the output shaft 31 of the drive unit 17 and the input shaft 26 of the dispensing cassette 16 are connected with each other via the coupling 32, 33.

As shown in FIG. 5, the drive unit 17 includes a main body case 34 which has an open end; a lid case 35 which closes the open end; and a cover case 36 which covers a closed end of the main body case 34. The bearing sleeve 37 is provided in the lid case 35 so as to protrude therefrom, and as described earlier, the output shaft 31 has its tip portion inserted into the bearing sleeve 37. The lid case 35 has a lead wire insertion hole 40 for electric components disposed therein.

Figure 6:
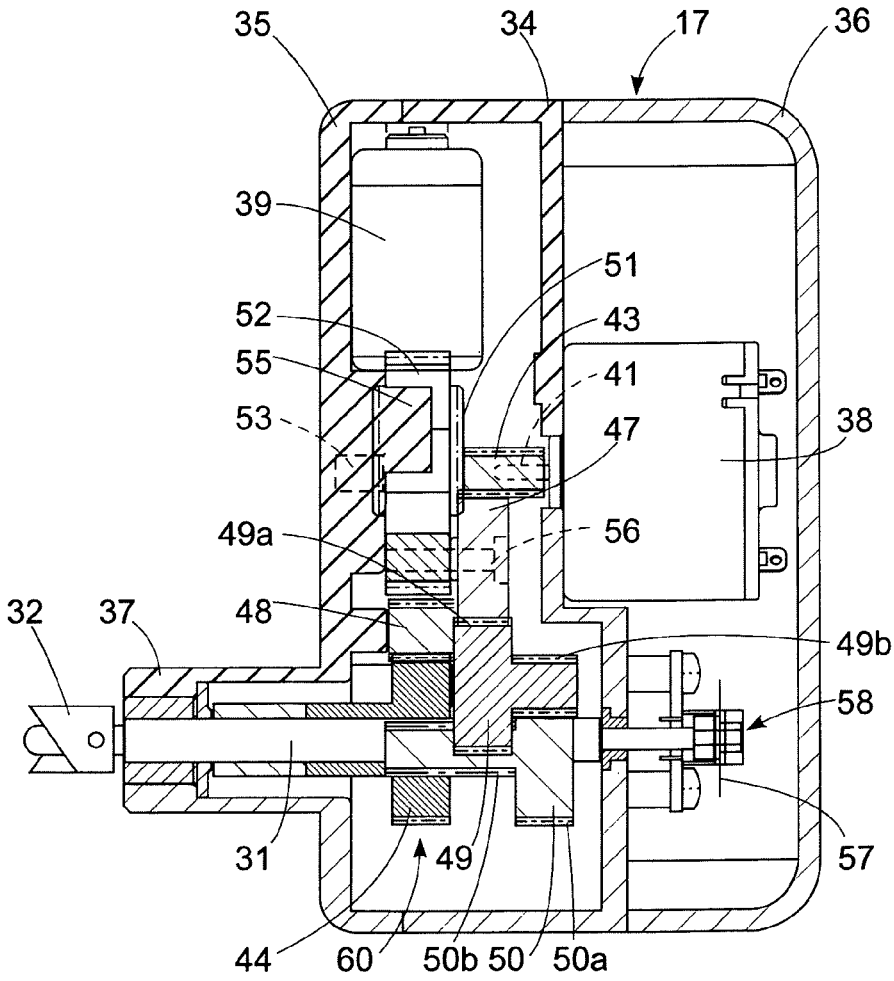
FIG. 6 is a sectional view taken along lines X2-X2 in FIG. 5.

As shown in FIG. 6, the drive unit 17 has two kinds of DC motors, i.e., a drive motor 38 and a switching motor 39. These motors 38, 39 are disposed so that their motor shafts 41, 42 (see FIG. 7) are perpendicular to each other. The drive motor 38 takes one of two states; normal rotation and stop. This motor is not controlled to rotate in a reverse direction. The switching motor 39 is controlled to make whichever of normal and reverse rotations.

The drive motor 38 is mounted to a back surface of the main body case 34 and is covered by the cover case 36. The motor shaft 41 of the drive motor 38 protrudes into the main body case 34, and a drive gear 43 is mounted to the protruding portion. Also, the output shaft 31 is mounted with an output gear 44. The output shaft 31 penetrates the closed end surface of the main body case 34, with a rear end reaching inside the cover case 36.

As shown in FIG. 6, a gear transmission device 60 which includes the above-described drive gear 43 and output gear 44 is provided between the motor shaft 41 and the output shaft 31. The gear transmission device 60 includes a plurality of gears and provides thereby, two transmission paths, i.e., a normal-rotation transmission path 45 (see FIG. 7 and FIG. 8) and a reverse-rotation transmission path 46 (see FIG. 7 and FIG. 10).

The drive gear 43, the output gear 44 and a switching gear 47 work in both of the transmission paths 45, 46 as common members. This simplifies the transmission paths. The switching gear 47 is always in engagement with the drive gear 43, and as will be described later, can be switched to belong to the normal-rotation transmission path 45 or to belong to the reverse-rotation transmission path 46 by a switcher which includes the switching motor 39.

Figure 7:
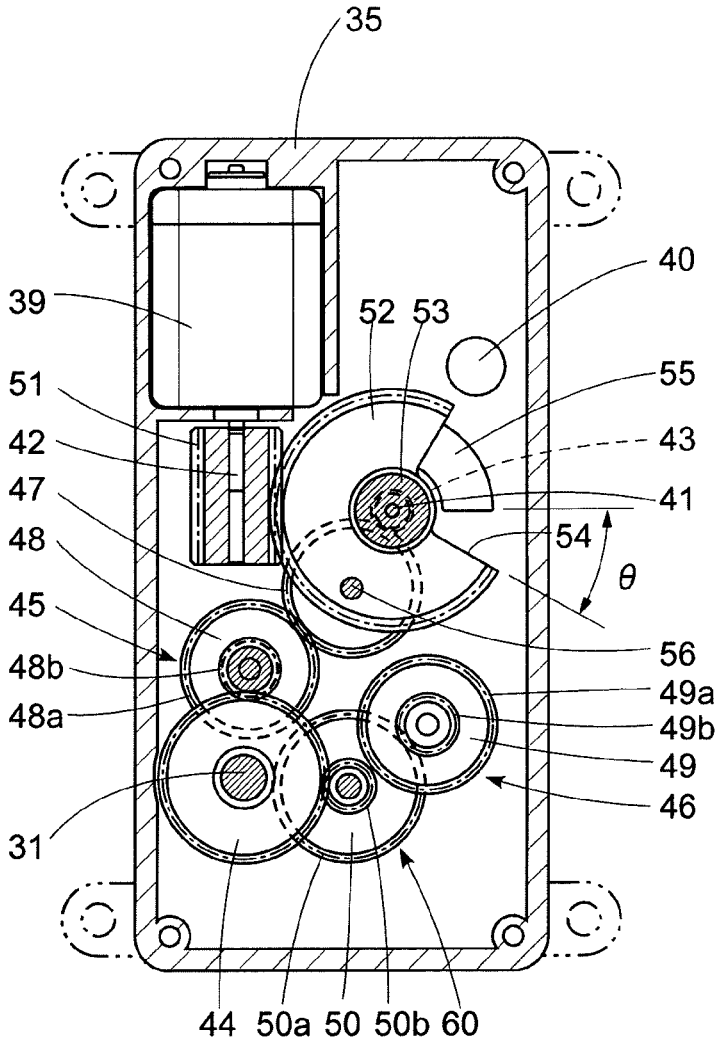
FIG. 7 is a sectional view taken along lines X3-X3 in FIG. 6.
Figure 8:
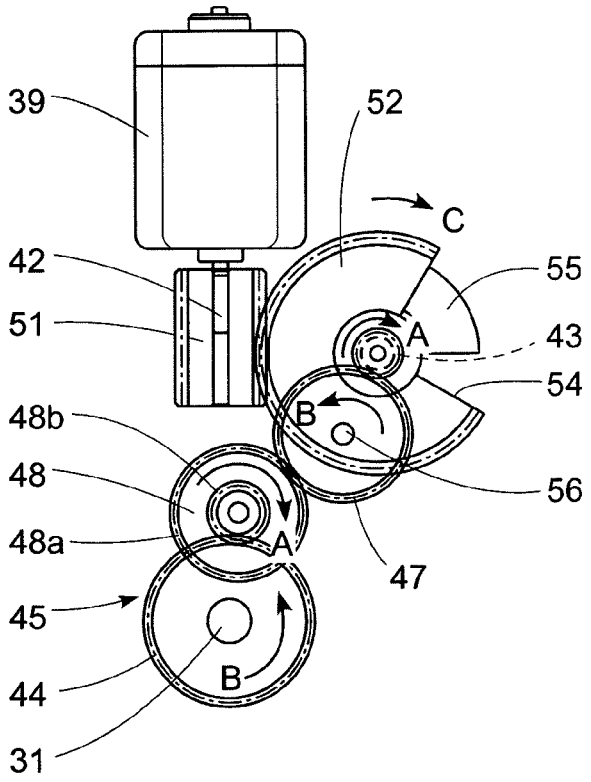
FIG. 8 is a schematic illustration of a gear train in normal rotation transmission.
Figure 9:
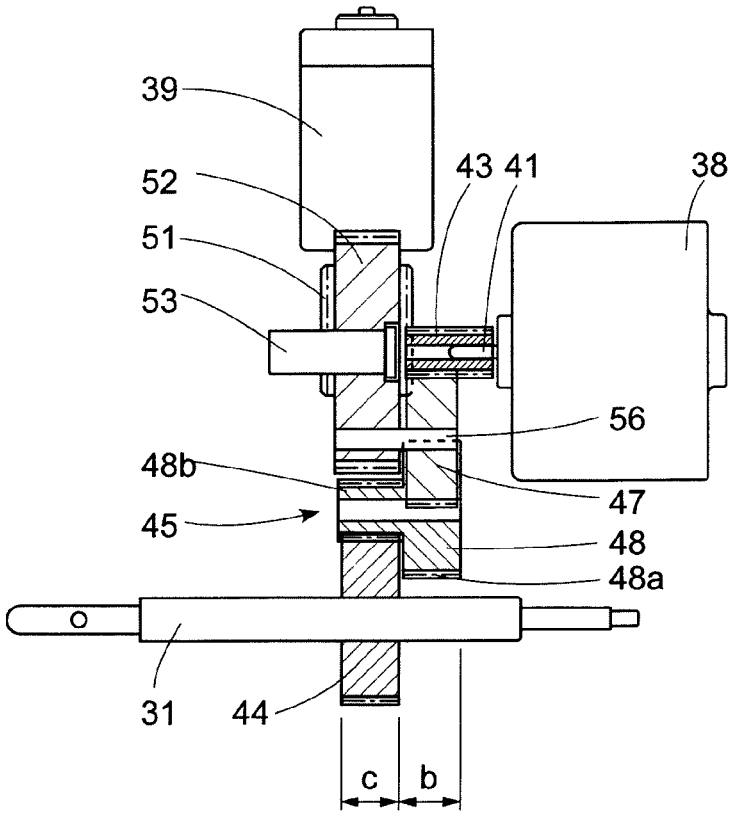
FIG. 9 is a side view of a vertical section taken in FIG. 8.

FIG. 6 and FIG. 7 show a case where the switching gear 47 belongs to the normal-rotation transmission path 45. In FIG. 8 and FIG. 9, the normal-rotation transmission path 45 is highlighted by not illustrating the reverse-rotation transmission path 46.

The normal-rotation transmission path 45 is provided by the drive gear 43, the switching gear 47, a middle gear 48 and the output gear 44 engaged mutually one after another. As shown in FIG. 8, the middle gear 48 is a two-stage gear, having a large-diameter wheel 48*a* engaged with the switching gear 47, and a small-diameter wheel 48*b* engaged with the output gear 44. With an even number (four) of gears, normal rotation of the drive motor 38 causes reverse rotation of the output gear 44, and reverse rotation of the output shaft 31.

As described, in the dispensing cassette 16, which is connected with the output shaft 31, reverse rotation of the input shaft 26 causes the rotor 19 to make normal rotation (see FIG. 4). Thus, as the drive motor 38 makes normal rotation in the drive unit 17, normal rotation drive power is transmitted via the normal-rotation transmission path 45 to the rotor 19, and a tablet is dispensed.

Figure 10:
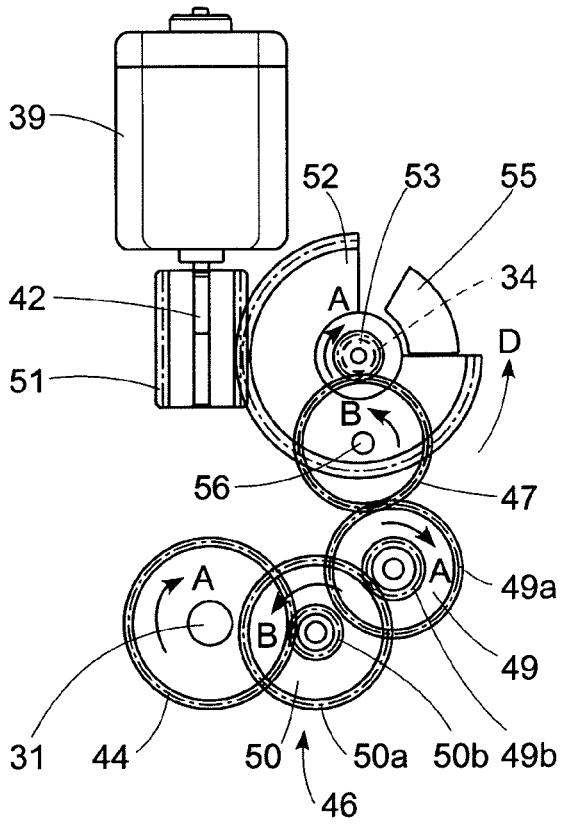
FIG. 10 is an explanatory drawing of a gear train in reverse rotation transmission.

On the other hand, if the switching motor 39 shifts the switching gear 47 to belong to the reverse-rotation transmission path 46 as will be described later, the reverse-rotation transmission path 46 is established by a gear train as shown in FIG. 10, including the drive gear 34, the switching gear 47, a first middle gear 49, a second middle gear 50 and the output gear 44 which are engaged mutually one after another. Each of the first middle gear 49 and the second middle gear 50 is provided by a two-stage gear. The former has a large-diameter wheel 49*a* engaged with the switching gear 47, and a small-diameter wheel 49*b* engaged with a large-diameter wheel 50*a* of the second middle gear 50. The second middle gear 50 has a small-diameter wheel 50*b* engaged with the output gear 44.

In this case, with an odd number (five) of the gears, normal rotation of the drive motor 38 makes normal rotation of the output gear 44. As a result, in the dispensing cassette 16 which is connected with the output shaft 31, the input shaft 26 makes normal rotation, and thereby the rotor 19 makes reverse rotation. In other words, normal-rotation drive power of the drive motor 38 is transmitted via the reverse-rotation transmission path 46 for reverse rotation of the rotor 19 to clear clogging of a tablet, for example.

Next, the normal-rotation transmission path 45 and the reverse-rotation transmission path 46 will be described in terms of their gear arrangement in gear axial direction. For the sake of description, gear axial positions will be divided into three layers as shown in FIG. 6, which will be called Layer "a", Layer "b", and Layer "c" starting from the side closest to the drive motor 38.

First, the normal-rotation transmission path 45 will be described based on FIG. 8 and FIG. 9. The drive gear 43 is in Layer "b" (see FIG. 9). The drive gear 43 is always in engagement with the switching gear 47, which is also in Layer "b". The switching gear 47 engages with the middle gear 48, which is a two-stage gear as described earlier, and its large-diameter wheel 48*a* is in Layer "b", being in engagement with the switching gear 47. The small-diameter wheel 48*b* is in Layer "c". The small-diameter wheel 48*b* is in engagement with the output gear 44 which is also in Layer "c".

Figure 11:
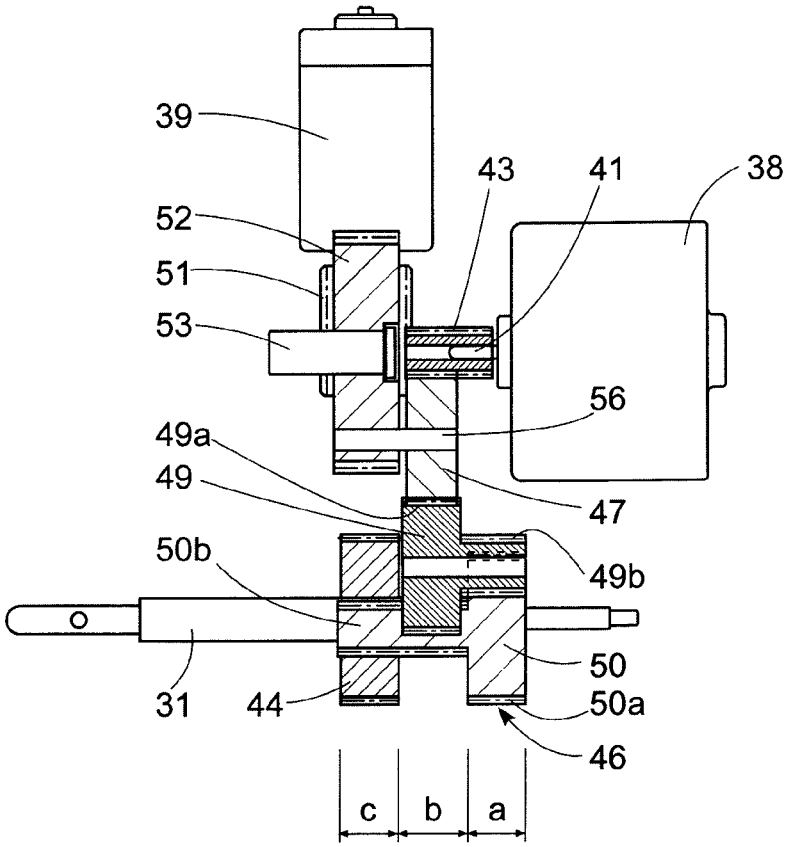
FIG. 11 is a side view of a vertical section taken along FIG. 10.

Now, turning to the reverse-rotation transmission path 46, as will be understood from FIG. 6 and FIG. 11, the drive gear 43 and the switching gear 47 are in Layer "b" like in the previous case. The first middle gear 49 has its large-diameter wheel 49*a* in Layer "b" and in engagement with the switching gear 47 whereas the small-diameter wheel 49*b* is in Layer "a". The second middle gear 50 has its large-diameter wheel 50*a* in Layer "a" and in engagement with the small-diameter wheel 49*b* of the first middle gear 49. The small-diameter wheel 50*b* extends to Layer "c" for engagement with the output gear 44 in Layer "c". The small-diameter wheel 50*b* of the second middle gear 50 has a smaller diameter than the output gear 44 for rotation at a predetermined speed reduction ratio.

A comparison between the normal-rotation transmission path 45 and the reverse-rotation transmission path 46 will reveal that the middle gear 48 in the former is essentially of the same size as the first middle gear 49 in the latter, and so the difference in the quantity of gears between the two gear trains 48, 49 is only one, i.e., whether or not the gear train has the second middle gear 50.

In reverse rotation transmission, as shown in FIG. 10, the second middle gear 50 has its large-diameter wheel 50*a* in engagement with the first middle gear 49 in the previous stage while its small-diameter wheel 50*b* is in engagement with the output gear 44 in the next stage. Compared to the normal rotation transmission illustrated in FIG. 8, this gear arrangement has an additional speed reduction stage provided by the smaller-diameter wheel 50*b* and the larger-diameter output gear 44. The arrangement provides a greater speed reduction ratio in the reverse rotation transmission than in the normal rotation transmission, providing a relatively greater reverse rotation torque concomitantly.

It should be noted here that in cases where the quantity of gears in the gear transmission section 21 (see FIG. 4) of the dispensing cassette 16 is greater by one, or smaller by one, than the above-described case, direction of rotation will be opposite from the above-described case; i.e., inputting normal rotation to the input shaft 26 will cause the rotor 19 to make normal rotation. In this case, therefore, the above-described normal-rotation transmission path 45 in the drive unit 17 will function as a reverse-rotation transmission gear train, i.e. a reverse-rotation transmission path. Likewise, the reverse-rotation transmission path 46 will work as a normal-rotation transmission gear train, i.e., a normal-rotation transmission path.

In whichever of the cases, independent from the gear configuration of the gear transmission section 21 in the dispensing cassette 16, the drive unit 17 has a normal-rotation transmission path for transmission of normal rotation to the rotor 19, and a reverse-rotation transmission path for transmission of reverse rotation thereto; and switching is performed to select one of the gear trains so that the output shaft 31 makes normal rotation or reverse rotation. The gear train to be switched to will be determined by the gear configuration of the gear transmission section 21 in the dispensing cassette 16.

Next, the switcher will be described. As shown in FIG. 6 and FIG. 7, the switcher is composed of the switching motor 39 which is controlled to rotate in whichever of the normal and reverse directions; a worm gear 51 which is attached to a motor shaft 42 of the motor; and a worm ring 52. The worm ring 52 has a rotation shaft 53, which is separate from but coaxial with a drive shaft 41 of the drive motor 38. As shown in FIG. 6, the worm ring 52 is in Layer "c" in terms of the axial position.

The worm ring 52 is formed with a cutout portion 54 (see FIG. 7), which has a 90 degree center angle. A sector-shaped stopper 55 having a smaller center angle than the cutout portion 54 is formed in an inner surface of the lid case 35. The stopper 55 protrudes into the cutout portion 54. A rotation angle of the worm ring 52 is limited within a range of angle difference θ (see FIG. 6) between the cutout portion 54 and the stopper 55. The worm ring 52 functions as a rotation member whose rotation range is limited within the range of the angle difference θ.

The switching motor 39 is controlled so as to rotate the worm ring 52 in an angle range which is defined as a sum of the angle difference θ and a predetermined margin-angle. Thus, the worm ring 52 reliably makes contact with the stopper 55, and stops. The arrangement ensures accurate setting of two, right and left stop positions of the switching gear 47.

The switching motor 39 may be provided by a stepping motor. In such a case, the stopper 55 may be eliminated since stepping motors can provide highly accurate control on the rotation angle.

The switching gear 47 is rotatably supported by a shaft 56 in an end surface of the worm ring 52 which is the end surface closer to the drive motor 38. As shown in FIG. 8 and FIG. 9, at this position, the switching gear 47 has a rotation radius for engagement with the drive gear 43 in its circumferential direction. Also in the circumferential direction, this is a position for engagement with the middle gear 48, under the state where the worm ring 52 is in stoppage after it has made right-hand rotation (see Arrow C in FIG. 8) and has made contact with the stopper 55.

The angle difference θ is set to a value, with which the switching motor 39 makes reverse rotation, causing the worm gear 51 and the worm ring 52 to make reverse rotation (see Arrow D in FIG. 10) and subsequently causing the worm ring 52 to make contact with and to stop on the opposite surface of the stopper 55, so that the switching gear 47 disengages from the middle gear 48 in the normal-rotation transmission path 45 and engages with the first middle gear 49 in the reverse-rotation transmission path 46.

It should be noted here that the sector-shaped stopper 55 may be replaced by limit pins erected at two positions representing the two side surfaces of the stopper.

Figure 12:
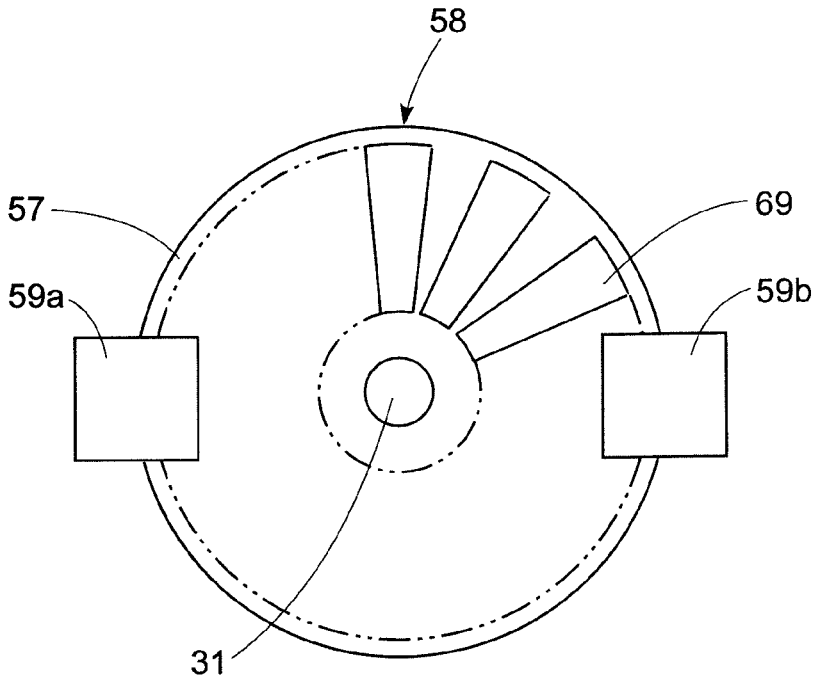
FIG. 12 is a front view of a rotor-rotation detection sensor.

As shown in FIG. 6, the output shaft 31 penetrates into the cover case 36, and the penetrating end of the shaft is provided with a rotor-rotation detection sensor 58. As shown in FIG. 12, the rotor-rotation detection sensor 58 is provided by a two-phase pulse-output rotary encoder which is composed of a rotating plate 57 having a large number of slits 69, and two optical sensors 59*a*, 59*b* for detecting light which passes through these slits 69. Although the Figure shows that the sensors 59*a*, 59*b* are opposed to each other in a diametrical direction of the rotating plate 57, sensor positions are not limited to this layout, and may be selected arbitrarily as long as a predetermined phase difference is obtained.

The sensors 59*a*, 59*b* output two, phase-different pulse signals to a control circuit 61 (see FIG. 13) which is to be described later, and the control circuit 61 determines whether the rotating plate 57 is making normal rotation or reverse rotation, i.e., whether the rotor 19 is making normal rotation or reverse rotation. Also, one of the sensors 59*a*, 59*b* is used to detect whether the rotor 19 is rotating or not.

Figure 13:
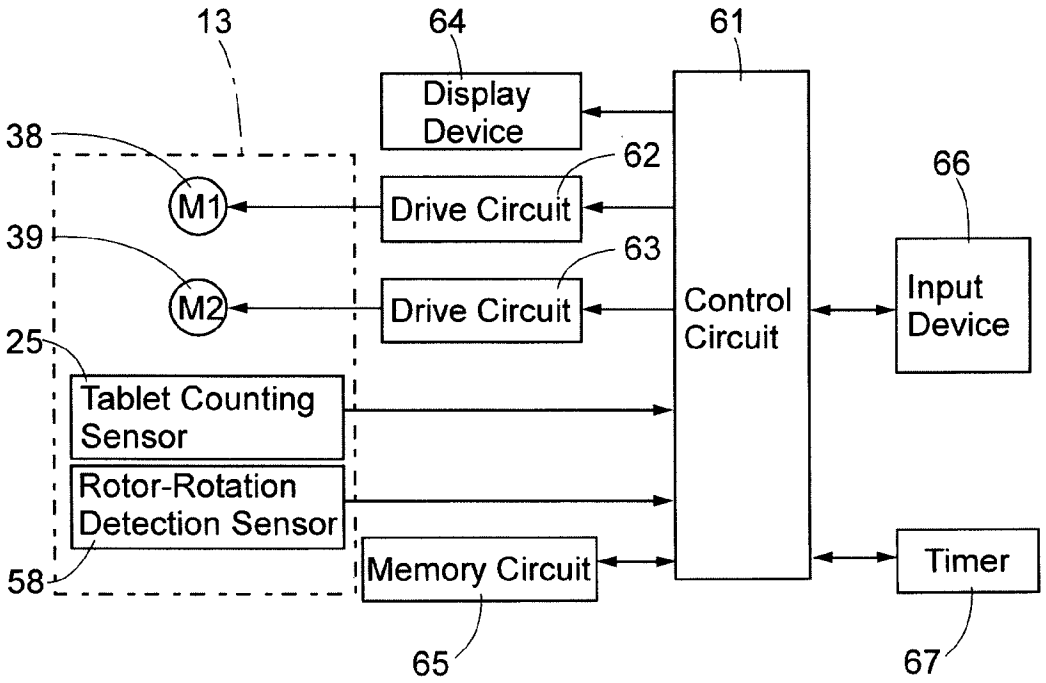
FIG. 13 is a control block diagram of the medicine dispenser according to the first embodiment.

Next, a control block diagram in FIG. 13 of the medicine dispenser 11 will be explained. The control circuit 61 is provided by a microcomputer, with a memory circuit 65 which includes a RAM and a ROM. The memory circuit 65 stores programs for performing various control operations to be described below.

Specifically, the control circuit 61 controls the drive motor 38 of the medicine feeder 13 via a drive circuit 62, and controls the switching motor 39 via a drive circuit 63. Also, detection signals from the tablet counting sensor 25 and the rotor-rotation detection sensor 58 which are provided in the medicine feeder 13 are inputted to the control circuit 61.

The dispenser 11 is provided with a display device 64 for indication of errors such as a clogging error and a missing tablet error. These error indications are made in accordance with signals from the control circuit 61. The control circuit 61 works with an input device 66 which may be provided by a personal computer for example, and a timer 67. Through the input device 66, prescribing information, etc., is entered, and the information is stored in the memory circuit 65.

Figure 14:
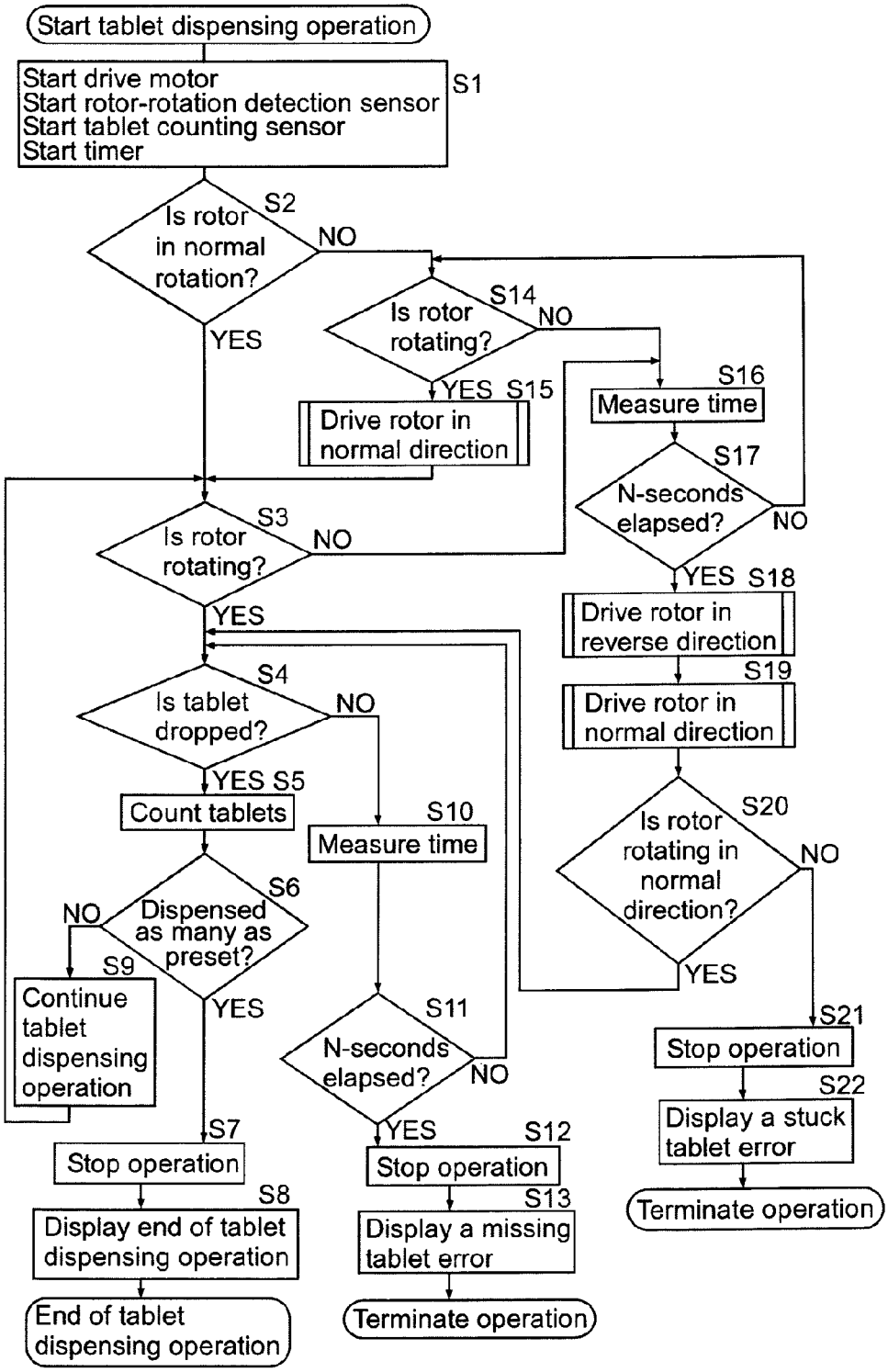
FIG. 14 is a flowchart for the first embodiment.

Next, control operations by the control circuit 61 will be described based on flowcharts in FIG. 14 through FIG. 16.

Upon commencement of a tablet dispensing operation, Step (hereinafter abbreviated simply as "S") 1 starts the drive motor 38, the rotor-rotation detection sensor 58, the tablet counting sensor 25 and the timer 67. If S2 determines that the rotor 19 is in normal rotation (YES), S3 checks to see if the rotor 19 is rotating. If rotating (YES), S4 determines whether or not a tablet has been dropped, based on a signal obtained from the tablet counting sensor 25.

If the tablet has been dropped (YES), S5 continues counting of the tablets until S6 determines that the quantity of the tablets has reached a quantity which is pre-set as prescribing information. When the count has reached the pre-set number (YES), S7 stops the tablet dispensing operation, makes a display which indicates completion of the tablet dispensing operation in the display device 64, and then the process brings the tablet dispensing operation to an end.

If S4 determines that a tablet has not been dropped (NO), S10 starts time measurement, and the process keeps coming back to S4 as long as S11 determines that a period of n seconds has not elapsed (NO). After the lapse of the n seconds (YES), S12 stops the operation. Then, S13 makes an error display about a missing tablet, and then the process brings the operation to an end.

If S2 determines that the rotor 19 is not in normal rotation (NO), the process branches off to S14, to see if the rotor 19 is rotating. If the rotor 19 is rotating (YES), the rotation is reverse rotation, so the process executes S15 subroutine (see FIG. 15 to be described later) to drive the rotor 19 in the normal rotation direction, and then returns to S3.

If S14 determines that the rotor 19 is not rotating (NO), it indicates, for example, that a jammed tablet or other trouble at the start up of operation has disabled the rotor 19 from rotating. Therefore, S16 is executed to start time measurement, and the process keeps coming back to S14 as long as S17 determines that a period of n seconds has not elapsed (NO). After the lapse of the time (YES), S18 subroutine (see FIG. 16 to be described later) is performed for driving the rotor 19 in reverse rotation direction as an attempt to clear the jammed tablet.

After S18 subroutine has attempted the reverse driving, S19 subroutine is executed to drive the rotor 19 in normal rotation direction. If S20 determines that the rotor 19 is turning in the normal rotation direction (YES), it is determined that the jammed tablet has been cleared, and the process goes back to S4. Otherwise (NO), S21 stops the operation, S22 makes an error display about a jammed tablet, and then the process brings the operation to an end.

If S3 determines that the rotor 19 is not rotating (NO), it indicates, for example, that a jammed tablet or other trouble during normal rotation of the rotor 19 in the dispensing operation has disabled the rotor 19 from rotating. Therefore, the process jumps to execute S16 and the steps from S17 through S19 for driving the rotor 19 in the reverse rotating direction and then the normal rotating direction, as an attempt to clear the jammed tablet. After S20 determines whether the rotor 19 is rotating in the normal rotation direction (YES), or not (NO), the process performs the operations, accordingly as described above.

Figure 15:
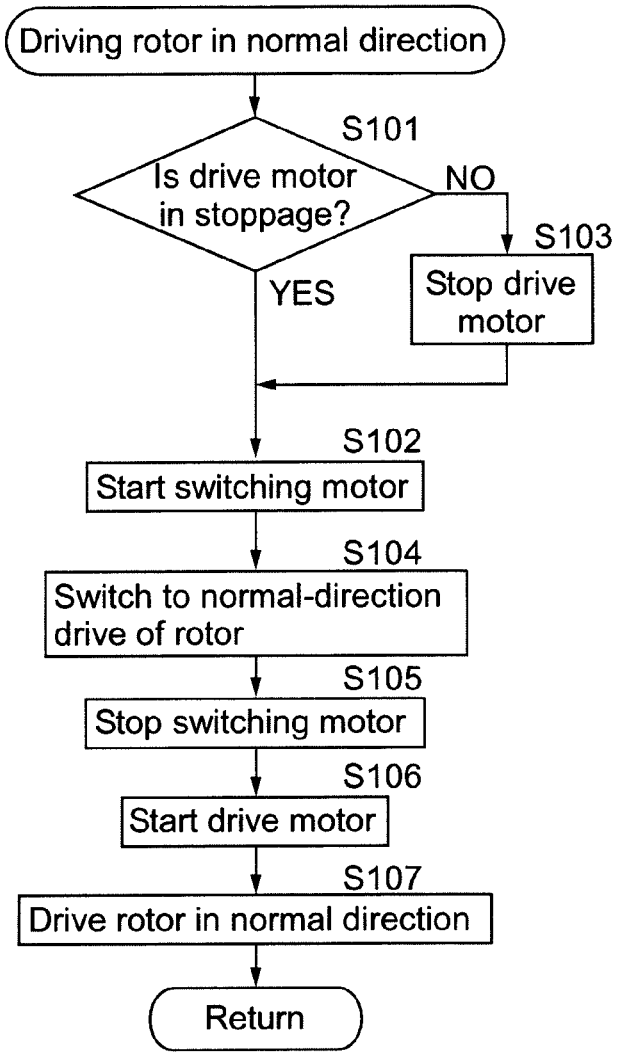
FIG. 15 is a flowchart for the first embodiment, for normal rotation of the rotor.

FIG. 15 shows the subroutine for driving the rotor in the normal rotation direction: If S101 determines that the drive motor 38 is in stoppage (YES), S102 drives the switching motor 39. If the drive motor 38 is not in stoppage (NO), S103 stops the drive motor 38.

In S104, the switching motor 39 is driven to switch the rotor 19 to rotate in the normal rotation direction. The switching motor 39 is stopped in S105, the drive motor 38 is driven in S106, and the rotor 19 is driven in the normal rotation direction, and then the process makes a return in S107.

Figure 16:
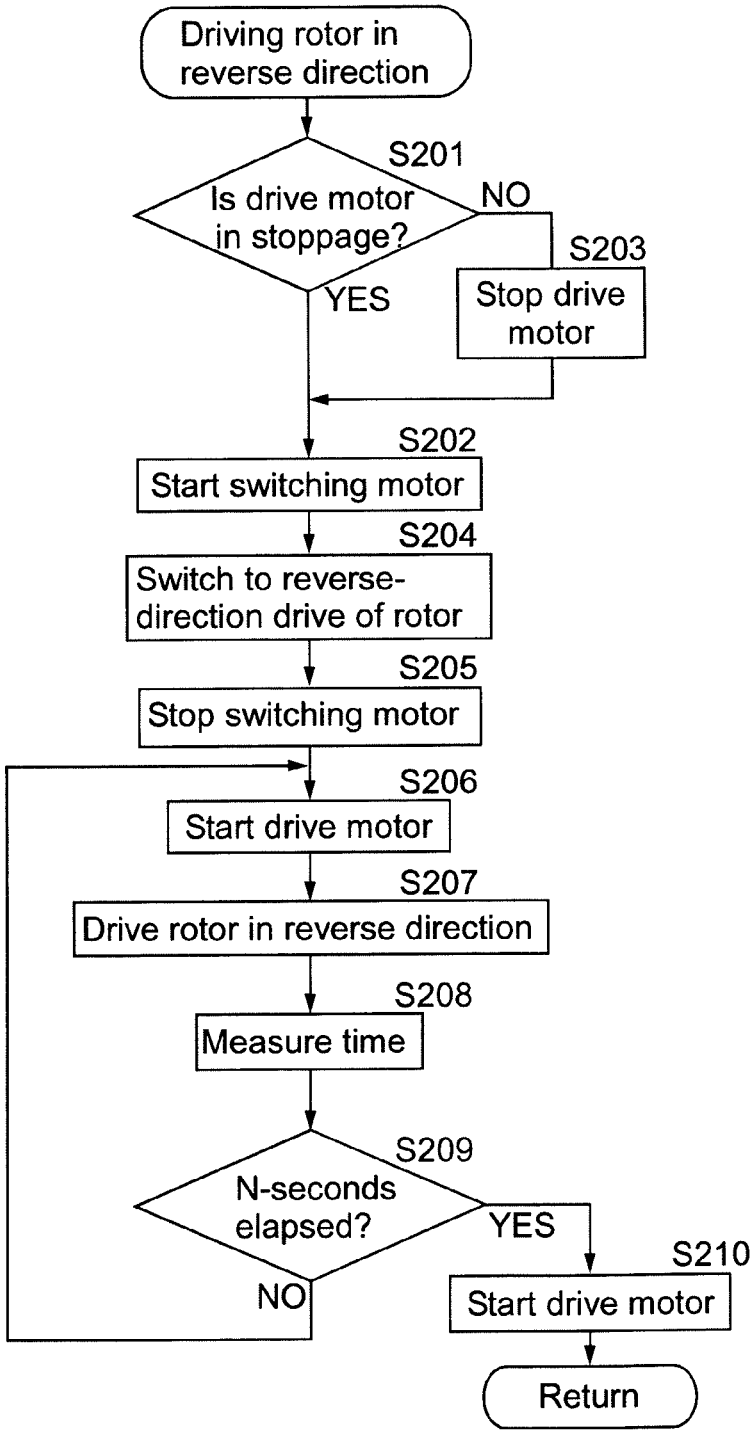
FIG. 16 is a flowchart for the first embodiment, for reverse rotation of the rotor.

FIG. 16 shows the subroutine for driving the rotor 19 in the reverse rotation direction: If S201 determines that the drive motor 38 is in stoppage (YES), S202 drives the switching motor 39. If the drive motor 38 is not in stoppage (NO), S203 stops the drive motor 38.

In S204, the switching motor 39 is driven to switch the rotor 19 to rotate in the reverse rotation direction. The switching motor 39 is stopped in S205, and the drive motor 38 is driven in S206. As the drive motor 38 is driven, the rotor 19 is driven in the reverse rotation direction in S207 and then time measurement is started in S208. S209 checks if a period of n seconds has elapsed, and if the obtained answer is NO, the process goes back to S206. If the obtained answer is YES, S210 drives the drive motor 38, and then the process makes a return.

The medicine dispenser 11 according to the first embodiment is configured as described thus far. In its medicine feeder 13, reverse rotation of the rotor 19 for clearing a jammed medicine is achieved by first stopping the drive motor 38, and then driving the switching motor 39 thereby switching the power transmission path to the reverse-rotation transmission path 46. Thereafter, the drive motor 38 is driven to make normal rotation, whereby driving power is transmitted to the rotor 19 via the reverse-rotation transmission path 46, causing the rotor 19 to rotate in the reverse direction. As described, the arrangement is capable of rotating the rotor 19 in the reverse direction not by driving the drive motor 38 in a reverse direction but by driving it in the normal direction. Thus, the arrangement can reduce the burden on the drive motor 38.

Also, as has been described, the arrangement provides, within the control circuit 61, means for determining whether or not the rotor 19 is rotating (S3 in FIG. 14), based on signals from the rotor-rotation detection sensor 58; and means for determining whether or not the tablet dispensing operation is proceeding successfully (S4 in FIG. 14), based on signals from the tablet counting sensor 25. Using these determination means, an error display is performed regarding a missing tablet (S13 in FIG. 14) if the rotor is rotating but a tablet has not been dispensed for a predetermined period of time (S11 in FIG. 11). The arrangement establishes differentiation between a jammed tablet and a missing tablet, thereby offering a reliable detection of a missing tablet in cases where a tablet is not dispensed.

Further, the arrangement provides a greater speed reduction ratio for drive power transmission via the reverse-rotation transmission path 46 than via the normal-rotation transmission path 45. Thus, it is possible to apply a relatively greater torque when rotating the rotor 19 in reverse. This facilitates smooth clearing of a jammed tablet.

It should be noted here that a detection of an overcurrent to the drive motor 38 or a detection by the tablet counting sensor 25 of a no-tablet-dispensed event may be used as a basis for the determination that a tablet has jammed, which is then followed by the above-described switching operation for driving the rotor 19 in reverse.

These functions and advantages are also offered by the second embodiment which will be described next.

Second Embodiment

A medicine dispenser 11 shown in FIG. 17 through FIG. 22 according to the second embodiment is essentially the same as the first embodiment (see FIG. 1) in its basic configuration. Also, a medicine feeder 13 includes a dispensing cassette 16 of the same configuration as in the previous embodiment (see FIG. 2 through FIG. 4). However, there are some differences in the internal structure of the drive unit 17.

Figure 17:
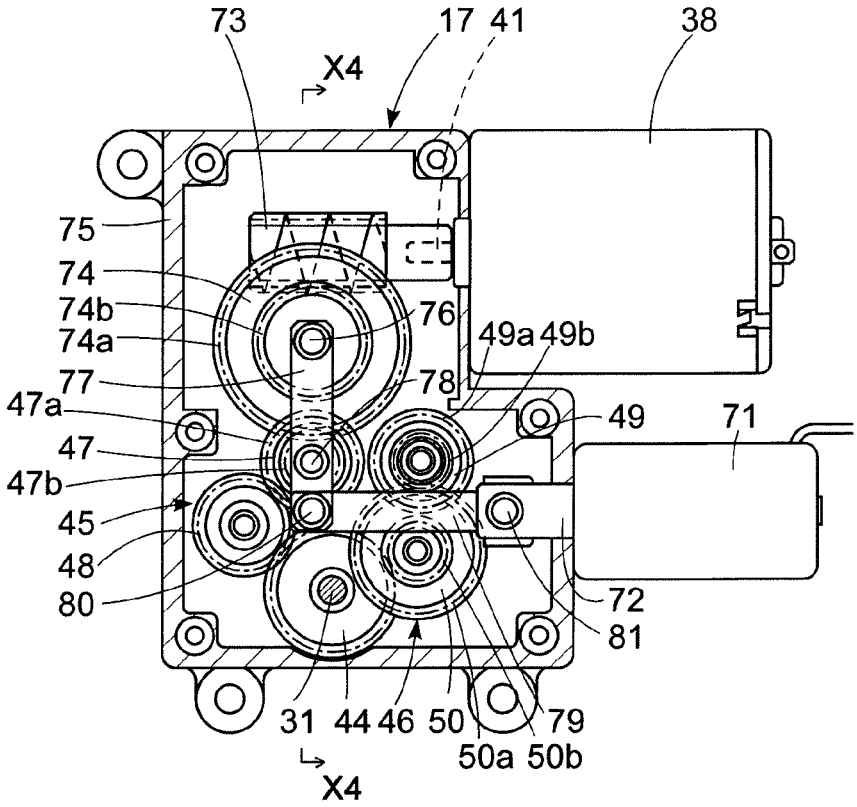
FIG. 17 is a sectional view of a drive unit according to a second embodiment.
Figure 18:
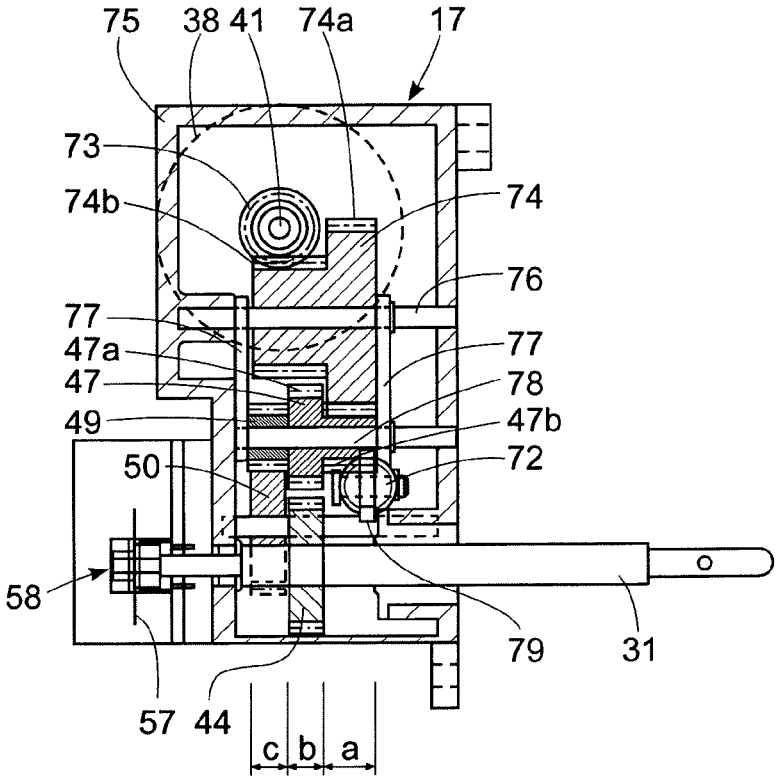
FIG. 18 is a sectional view taken along lines X4-X4 in FIG. 17.

Specifically, as shown in FIG. 17 and FIG. 18, the drive unit 17 according to the second embodiment has a drive motor 38, and a switching solenoid 71 (hereinafter, simply called solenoid 71) as a switching actuator. A motor shaft 41 of a drive motor 38 is parallel with a plunger 72 of the solenoid 71. Further, these two members are perpendicular to an output shaft 31.

A worm gear 73 is mounted to the motor shaft 41, and the worm gear 73 engages with a worm ring 74, which is mounted rotatably to a case 75. The worm ring 74 is a two-stage gear, which has a small-diameter wheel 74*b* engaged with the worm gear 73, whereas a large-diameter wheel 74*a* engages with a switching gear 47. The worm gear 73 has a left-hand helix. When the drive motor 38 makes normal rotation, the worm gear 73 on the motor shaft 41 makes normal rotation, and the worm ring 74 engaged thererwith makes normal rotation (see FIG. 19).

The worm ring 74 has a support shaft 76, which is supported by the case 75 (see FIG. 18). With this worm ring 74 in between, two pivot arms 77, 77 have their respective upper end portions attached pivotably to the support shaft 76. The switching gear 47 has a support shaft 78, which has its two end portions attached rotatably to intermediate portions of the pivot arms 77, 77. Also, one of the pivot arms 77 has its lower end portion movably connected with an end of an intermediate link 79 which is laid perpendicularly to the pivot arm, by a pin 80 (see FIG. 17).

The intermediate link 79 has a rear end portion, which is connected movably to the plunger 72 of the solenoid 71 by a pin 81. When the solenoid 71 is operated, the plunger 72 moves in a horizontal direction with movable joints provided by the two pins 80, 81, pivoting the pivot arms 77, 77 to perform a switching operation by bringing the switching gear 47 into a normal-rotation transmission path 45 or into a reverse-rotation transmission path 46.

Figure 19:
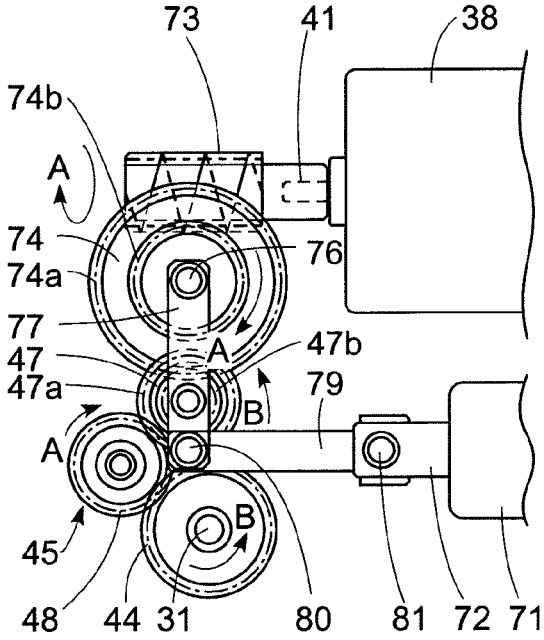
FIG. 19 is an explanatory drawing of a gear train in normal rotation transmission.
Figure 20:
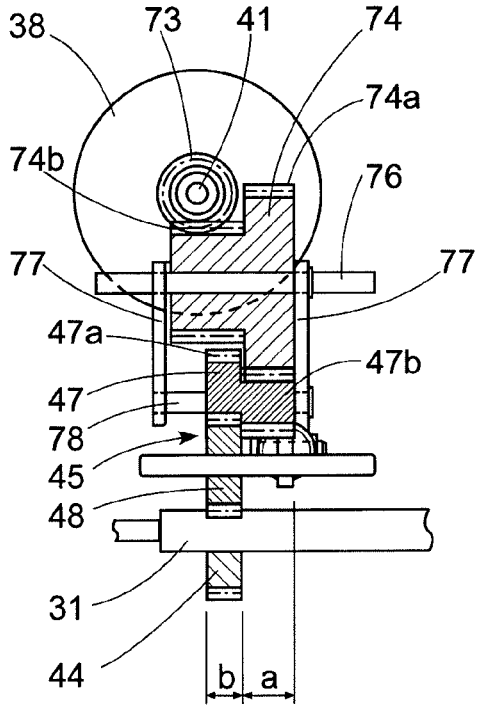
FIG. 20 is a side view of a vertical section taken in FIG. 19.

As shown in FIG. 19 and FIG. 20, the normal-rotation transmission path 45 in this case is constituted by four (even number of) gears, i.e., the worm ring 74 as a drive gear; the switching gear 47; a middle gear 48; and an output gear 44. Like in the first embodiment, the output gear 44 is attached to the output shaft 31. The switching gear 47 is a two-stage gear, which has a small-diameter wheel 47*b* engaged with the large-diameter wheel 74*a* of the worm ring 74. Also, the switching gear 47 has its large-diameter wheel 47*a* engaged with the middle gear 48.

Figure 21:
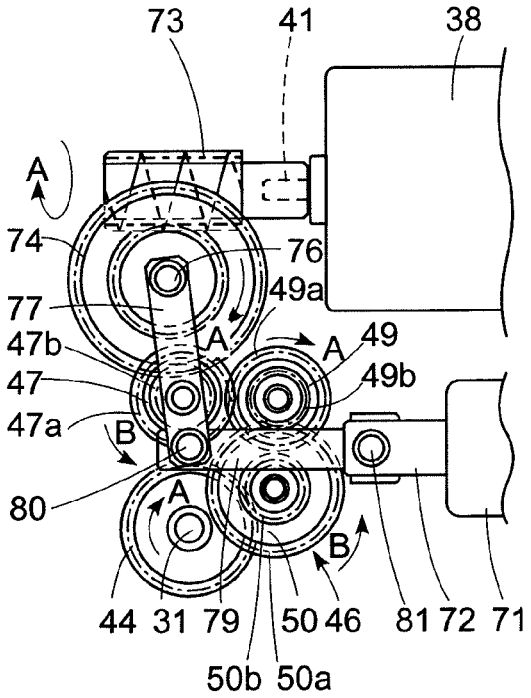
FIG. 21 is an explanatory drawing of a gear train in reverse rotation transmission.
Figure 22:
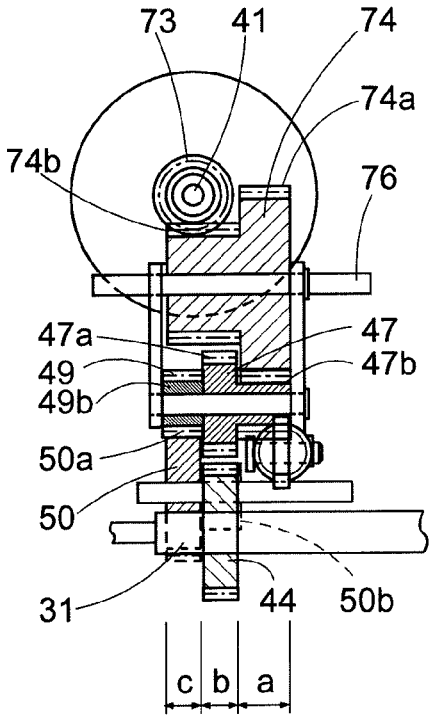
FIG. 22 is a side view of a vertical section taken in FIG. 20.

As shown in FIG. 21 and FIG. 22, the reverse-rotation transmission path 46 is constituted by five (odd number of) gears, i.e., the worm ring 74 as a drive gear; the switching gear 47; a first middle gear 49; a second middle gear 50; and the output gear 44. Each of the first middle gear 49 and the second middle gear 50 is provided by a two-stage gear: The former has a large-diameter wheel 49*a* engaged with a large-diameter wheel 47*a* of the switching gear 47; and a small-diameter wheel 49*b* engaged with a large-diameter wheel 50*a* of the second middle gear 50. The second middle gear 50 has a small-diameter wheel 50*b* engaged with the output gear 44.

FIG. 18 shows axial positional relationship of the above-described gears: the two-stage worm ring 74 has its large-diameter wheel 74*a* in Layer "a" whereas its small-diameter wheel 74*b* is located across Layer "b" and Layer "c".

FIG. 20 shows positional relationship in the normal-rotation transmission path 45: The large-diameter wheel 47*a* of the switching gear 47 is in Layer "b", and its small-diameter wheel 47*b* in Layer "a". The small-diameter wheel 47*b* is in engagement with the large-diameter wheel 74*a* of the worm ring 74. The middle gear 48 is in Layer "b" and is in engagement with the large-diameter wheel 47*a* of the switching gear 47. The output gear 44 is in Layer "b" and in engagement with the middle gear 48.

FIG. 22 shows positional relationship in the reverse-rotation transmission path 46: The large-diameter wheel 49*a* of the first middle gear 49 is in Layer "b" (behind the large-diameter wheel 47*a* of the switching gear 47 in the Figure) whereas the small-diameter wheel 49*b* is in Layer "c". The large-diameter wheel 49*a* is in engagement with the large-diameter wheel 47*a* of the switching gear 47, in Layer "b". The large-diameter wheel 50*a* of the second middle gear 50 is in Layer "c" whereas the small-diameter wheel 50*b* is in Layer "b". The large-diameter wheel 50*a* is in engagement with the small-diameter wheel 49*b* of the first middle gear 49 whereas the small-diameter wheel 50*b* is in engagement with the output gear 44 in Layer "b". The small-diameter wheel 50*b* of the second middle gear 50 has a smaller diameter than the output gear 44 for rotation at a predetermined speed reduction ratio.

A comparison between the normal-rotation transmission path 45 and the reverse-rotation transmission path 46 will reveal the following: After the switching gear 47, the normal-rotation transmission path 45 has only one gear engagement between the middle gear 48 and the output gear 44 (see FIG. 17), and their speed reduction ratio is relatively small. On the contrary, the reverse-rotation transmission path 46 has two gear engagements, i.e., one between the small-diameter wheel 49*b* of the first middle gear 49 and the large-diameter wheel 50*a* of the second middle gear 50; and the other between the small-diameter wheel 50*b* of the second middle gear 50 and the output gear 44. The two speed-reduction engagements provide a relatively large reduction ratio.

Figure 3:
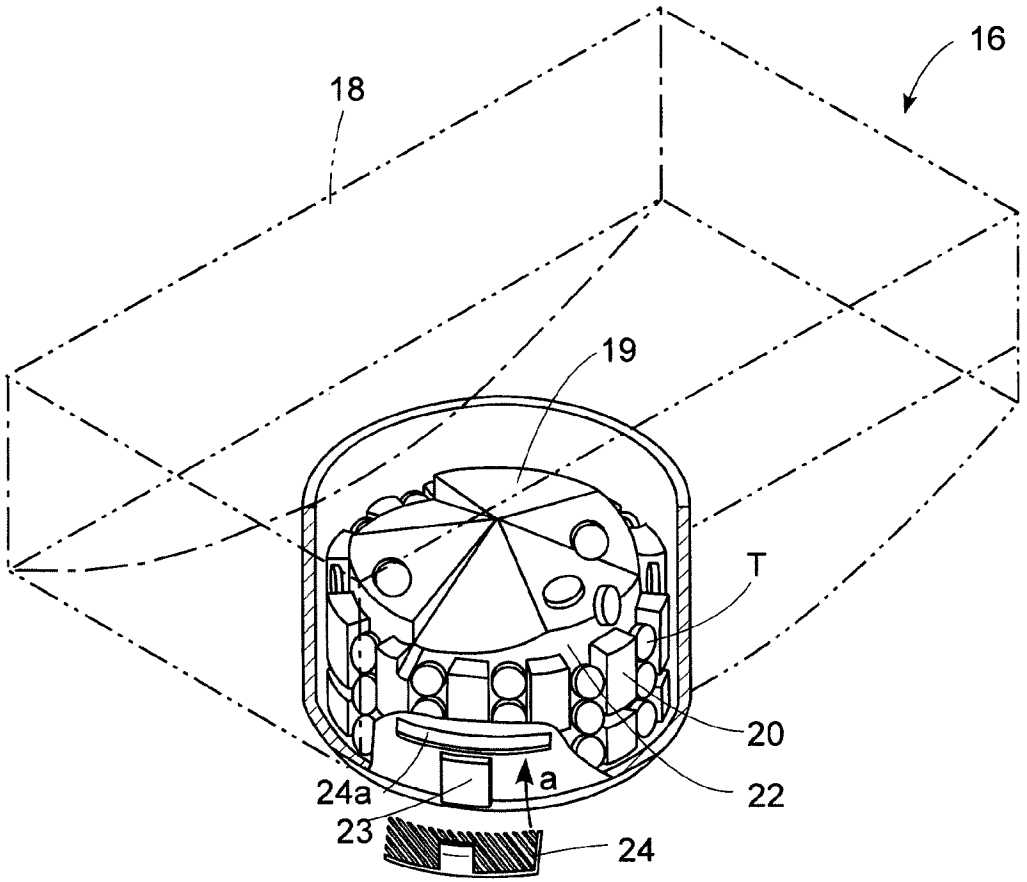
FIG. 3 is a perspective view of a vertical section of a rotor region in the medicine feeder.

The medicine dispenser according to the second embodiment is configured as described thus far. With the switching gear 47 switched to the normal-rotation transmission path 45 as shown in FIG. 19, the drive motor 38 gives normal rotation to the worm ring 74 via the worm gear 73; the rotation is transmitted via the normal-rotation transmission path 45; and the output shaft 31 makes reverse rotation. As shown in FIG. 3, the above-described operation causes the rotor 19 to make normal rotation in the dispensing cassette 16, and a tablet is dispensed.

Also, as shown in FIG. 21, the solenoid 71 is activated to move the plunger 72, the intermediate link 79 and the pivot arms 77, to switch the switching gear 47 to the reverse-rotation transmission path 46. The normal rotation of the drive motor 38 makes normal rotation of the worm ring 74; the rotation is transmitted via the reverse-rotation transmission path 46; and the output shaft 31 makes normal rotation. Thus, the rotor 19 rotates in the reverse direction in the dispensing cassette 16 as an attempt to clear a jammed tablet.

In the reverse rotation transmission after the reverse-rotation transmission path 46, a greater speed reduction ratio is obtained, as described earlier, than in the normal rotation transmission, as well as a relatively greater reverse rotation torque concomitantly.

Other aspects, including the rotor-rotation detection sensor 58 (see FIG. 18) provided on the output shaft 31, are the same as in the first embodiment. Also, the control block diagram and the flowchart for this embodiment are the same as in FIG. 13 through FIG. 16, differing only in that the "switching motor" is replaced by the "switching solenoid"

Third Embodiment

Figure 23:
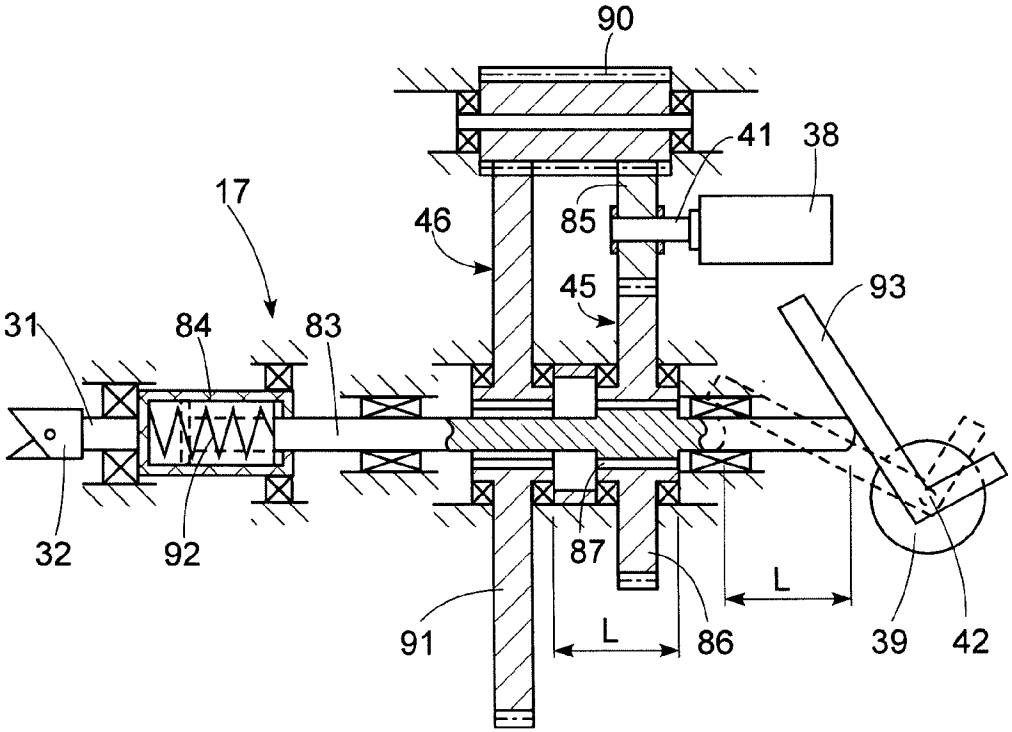
FIG. 23 is a simplified sectional view of a third embodiment.

FIG. 23 shows a medicine feeder according to a third embodiment, which includes a drive unit 17 having a drive motor 38 and a switching motor 39. Their motor shafts 41, 42 are perpendicular to each other, and a slide shaft 83 is provided in parallel to the motor shaft 41. The slide shaft 83 is rotatable integrally with an output shaft 31 via a damper 84. A coupling 32 is attached to a tip of the output shaft 31.

Figure 24A:
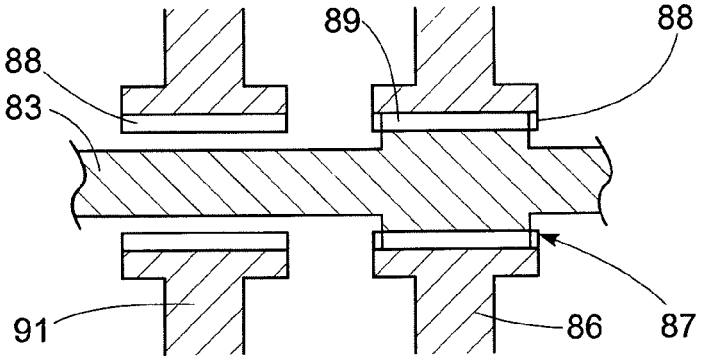
FIG. 24A is an enlarged sectional view of a clutch region in FIG. 23.

Between the motor shaft 41 of the drive motor 38 and the output shaft 31, a normal-rotation transmission path 45 and a reverse-rotation transmission path 46 are provided. The normal-rotation transmission path 45 is constituted by a drive gear 85 attached to the motor shaft 41, and an output gear 86 engaged therewith. The output gear 86 is coaxial with the slide shaft 83. The output gear 86 has a boss with an internal recess formed with a female spline 88 (see FIG. 24A) for engagement by a male spline 89 provided on the slide shaft 83.

The reverse-rotation transmission path 46 is constituted by the above-described drive gear 85, a middle gear 90 and an output gear 91. The output gear 91 is coaxial with the slide shaft 83. The output gear 91 has a boss with an internal recess formed with a female spline 88 (see FIG. 24A) for engagement by the above-described male spline 89 which is provided on the slide shaft 83. The output gear 91 has a sufficiently greater diameter than the first middle gear 90, so that a greater speed reduction ratio is obtained in this portion than in the normal-rotation transmission path 45.

Figure 24B:
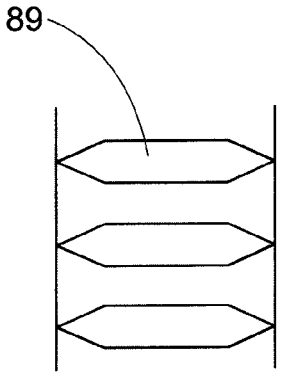
FIG. 24B is an enlarged partial plan view of a male spline in FIG. 23.

It should be noted here that desirably, the male spline 89 is tapered on its both end portions as shown in FIG. 24B so that the male spline 89 can make smooth engagement with the female spline 88 upon a reciprocal movement of the slide shaft 83 over a predetermined stroke L.

The damper 84 is provided at a rear end of the output shaft 31, with a spring 92 placed therein. The slide shaft 83 has its rear end inserted into the damper 84, to press the spring 92. A D-cut is provided in the slide shaft 83 where it is inserted into the damper 84, so that the slide shaft 83 and the output shaft 31 can rotate integrally with each other while allowing sliding movement relative to each other.

The slide shaft 83 has a tip, and this tip is pressed by a pivot arm 93 which is moved by the switching motor 39. As the pivot arm 93 pivots by a predetermined angle from a state drawn in solid lines in the FIG. 23, the slide shaft 83 is moved axially by a predetermined stroke L, disengaging the male spline 89 from the female spline 88 in the output gear 86, and engaging it with the female spline 88 in the output gear 91.

It should be noted here that the output shaft 31 is provided with the same rotor-rotation detection sensor 58 as in the first embodiment, although it is not illustrated in the drawings.

The third embodiment has been described thus far: When the switching motor 39 is in stoppage, the pivot arm 93 is in a retracted state as illustrated in solid lines in FIG. 23, and the male spline 89 of the slide shaft 83 is in engagement with the female spline 88 in the output gear 86.

As the drive motor 38 makes normal rotation under this state, the rotating power is transmitted via the normal-rotation transmission path 45, i.e., the drive gear 85 and the output gear 86 engaged therewith; and a clutch 87 provided by the female and male splines 88, 89; driving the slide shaft 83 and the output shaft 31 in the reverse rotation direction. In the dispensing cassette 16 (see FIG. 3) which is connected via a coupling 32, an input of the reverse rotation torque drives the rotor 19 in the normal rotation direction.

It should be noted here that in the above-described operation, the middle gear 90 and the output gear 91 move in association with the operation. However, their female spline 88 is not in engagement with the male spline 89, so there is no transmission of power to the slide shaft 83.

When the switching motor 39 is operated to move the pivot arm 93 to slide the slide shaft 83 by a predetermined stroke L, the male spline 89 is disengaged from the female spline 88 in the output gear 86, and engaged with the female spline 88 of the second middle gear 91. The movement of the slide shaft 83 is absorbed by the damper 84, so there is no axial positional change in the output shaft 31.

Upon the above-described switching, the normal-rotation drive power from the drive motor 38 is transmitted via the reverse-rotation transmission path 46, to drive the slide shaft 83 and the output shaft 31 in the normal rotation direction. The normal rotation is transmitted via the coupling 32 to the dispensing cassette 16, driving the rotor 19 in reverse.

Since a greater speed reduction ratio is obtained in this driving power transmission via the reverse-rotation transmission path 46 than via the normal-rotation transmission path 45, the rotor 19 receives a relatively greater reverse rotation torque.

The drive unit described thus far according to the third embodiment is coupled with the dispensing cassette 16 to constitute the earlier-described medicine feeder 13 like in the first and second embodiments, and is mounted in the medicine dispenser 11. A control block diagram and a flowchart for this embodiment are the same as in FIG. 13 through FIG. 16.

Fourth Embodiment

Figure 25:
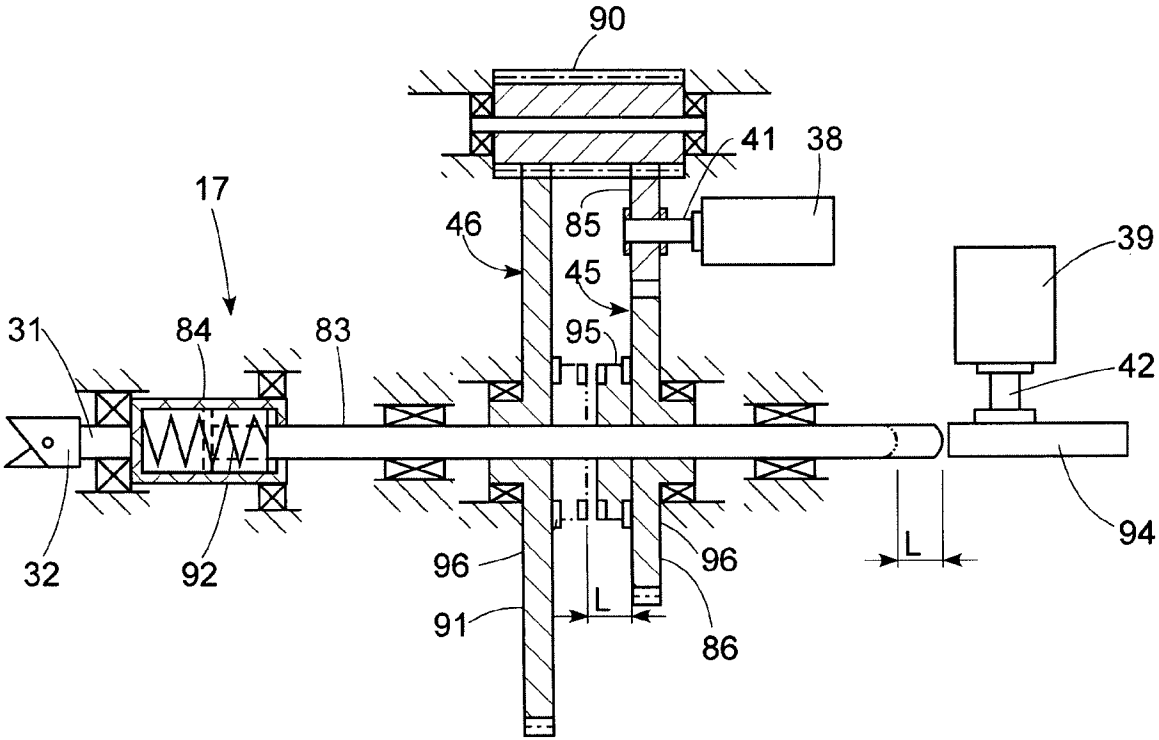
FIG. 25 is a simplified sectional view of a fourth embodiment.

FIG. 25 shows a drive unit 17 according to a fourth embodiment, which is essentially the same as in the third embodiment, with differences in its switcher. Specifically, the switcher in the present embodiment has an eccentric cam attached to a motor shaft 42 of a switching motor 39. Also, a clutch plate 95 is attached to a slide shaft 83 between the output gear 86 of the normal-rotation transmission path 45 and the output gear 91 of the reverse-rotation transmission path 46.

While the switching motor 39 is in stoppage, the eccentric cam 94 does not work on the slide shaft 83 as shown in the Figure. The clutch plate 95 is in engagement with an engagement projection 96 of the output gear 86, so the power is transmitted via the slide shaft 83, to drive the output shaft 31 in the reverse rotation direction.

As the switching motor 39 is driven, the eccentric cam 94 slides the slide shaft 83 by a predetermined stroke L. In this movement, the clutch plate 95 is disengaged from the output gear 86, moved toward the output gear 91, and engaged with the projection 96, so that the power is now transmitted via the slide shaft 83 to drive the output shaft 31 in the normal rotation direction.

It should be noted here that the drive unit according to the fourth embodiment is also provided with a rotor-rotation detection sensor for the output shaft 31, coupled with the dispensing cassette 16 like in the third embodiment to constitute the earlier-described medicine feeder 13, which is mounted in the medicine dispenser 11. A control block diagram and a flowchart for this embodiment are the same as those given in FIG. 13 through FIG. 16.

LEGEND

11 Medicine dispenser
13 Medicine feeder
16 Dispensing cassette
17 Drive unit
18 Medicine storage
19 Rotor
25 Tablet counting sensor
26 Input shaft
31 Output shaft
38 Drive motor
39 Switching motor
41 Motor shaft
43 Drive gear
44 Output gear
45 Normal-rotation transmission path
46 Reverse-rotation transmission path
47 Switching gear
57 Rotating plate
58 Rotor-rotation detection sensor
61 Control circuit
62 Drive circuit
63 Drive circuit
71 Solenoid

The invention claimed is:

1. A medicine dispenser comprising a medicine feeder, a control circuit and a display device, wherein:

the medicine feeder is provided by a combination of a medicine dispensing cassette and a drive unit; and the dispensing cassette includes a medicine storage for storing medicine, and a rotor at a bottom portion of the medicine storage, the rotor having a rotor shaft;

the drive unit including a drive motor, a gear transmission device, a switcher, a tablet counting sensor and a rotor-rotation detection sensor;

the drive motor having a motor shaft rotatable in a normal rotation direction;

the gear transmission device having a normal-rotation transmission path and a reverse-rotation transmission path each constituted by a predetermined quantity of gears provided between the motor shaft of the drive motor and the rotor shaft;

the switcher being configured to select one of the transmission paths for output of driving power from the drive motor to the dispensing cassette, to transmit the driving power from the drive motor, via the motor shaft rotating in the normal rotation direction, to the rotor shaft for rotating the rotor shaft in a normal direction or a reverse direction;

the control circuit controlling the drive unit for reverse rotation of the rotor for a predetermined period of time followed by resumption to normal rotation thereafter, upon detection of a stoppage of the rotor based on a signal from the rotor-rotation detection sensor.

2. The medicine dispenser according to claim 1, wherein the reverse-rotation transmission path has a greater speed reduction ratio than the normal-rotation transmission path.

3. The medicine dispenser according to claim 1, wherein gears included in the normal-rotation transmission path and gears included in the reverse-rotation transmission path differ from each other in quantity by an odd number.

4. The medicine dispenser according to claim 1, further comprising a rotor-rotation detection sensor provided by a rotary encoder including: a rotating plate attached to an output shaft of the gear transmission device and having a large number of slits; and a pair of optical sensors disposed in association with the rotating plate.

5. The medicine dispenser according to claim 1, wherein the switcher includes a switching actuator and a rotation member for rotation within a limited range, the rotation member rotatably supporting the switching gear, the switching actuator rotating the rotation member by a predetermined angle for bringing the switching gear into one of the transmission paths while allowing the switching gear in constant engagement with the drive gear.

6. The medicine dispenser according to claim 5, wherein the switching actuator includes a switching motor and a worm gear connected with a motor shaft of the switching motor; the rotation member being provided by a worm ring engaged with the worm gear; the worm ring being supported coaxially with the drive gear.

7. The medicine dispenser according to claim 1, wherein the control circuit outputs to the display device an error display signal regarding a missing tablet, upon detection of rotation of the rotor based on a signal from the rotor-rotation detection sensor and detection of non-dispensing of a tablet for a predetermined period of time based on a signal from the tablet counting sensor.

* * * * *